US008789531B2

(12) United States Patent
Li

(10) Patent No.: US 8,789,531 B2
(45) Date of Patent: Jul. 29, 2014

(54) MOUTH AND NOSE MASK FOR PREVENTING AND TREATING ALLERGIC RESPIRATORY DISEASES

(76) Inventor: Qi Li, Shanghai (CN)

( * ) Notice: Subject to any disclaimer, the term of this patent is extended or adjusted under 35 U.S.C. 154(b) by 521 days.

(21) Appl. No.: 13/160,531

(22) Filed: Jun. 15, 2011

(65) Prior Publication Data

US 2011/0240023 A1 Oct. 6, 2011

Related U.S. Application Data

(63) Continuation of application No. PCT/CN2010/070353, filed on Jan. 26, 2010.

(30) Foreign Application Priority Data

Mar. 13, 2009 (CN) ..... 2009 1 0047562
Mar. 13, 2009 (CN) ..... 2009 2 0068835 U
May 20, 2009 (CN) ..... 2009 1 0051585

(51) Int. Cl.
*A61M 11/00* (2006.01)

(52) U.S. Cl.
USPC ..... 128/206.12; 128/206.15; 128/206.28

(58) Field of Classification Search
USPC ..... 128/206.12, 206.15, 206.17, 206.25, 128/207.12
See application file for complete search history.

(56) References Cited

U.S. PATENT DOCUMENTS

| | | | | | |
|---|---|---|---|---|---|
| RE20,135 | E | * | 10/1936 | Bjurstrom | 128/204.17 |
| 4,090,510 | A | * | 5/1978 | Segersten | 128/206.12 |
| 4,361,146 | A | * | 11/1982 | Woicke | 128/206.12 |
| 4,873,972 | A | * | 10/1989 | Magidson et al. | 128/206.12 |
| 4,945,907 | A | * | 8/1990 | Tayebi | 128/206.12 |
| 4,963,327 | A | * | 10/1990 | Russell | 422/120 |
| 5,094,236 | A | * | 3/1992 | Tayebi | 128/206.12 |
| 5,535,736 | A | * | 7/1996 | Jzaw | 128/202.26 |
| 5,603,317 | A | * | 2/1997 | Farmer | 128/205.27 |
| 5,617,849 | A | * | 4/1997 | Springett et al. | 128/206.24 |
| 6,338,340 | B1 | * | 1/2002 | Finch et al. | 128/205.27 |
| 6,817,362 | B2 | * | 11/2004 | Gelinas et al. | 128/206.17 |
| 7,243,650 | B2 | * | 7/2007 | Thornton | 128/205.25 |
| 2005/0139217 | A1 | * | 6/2005 | Chiam | 128/206.19 |

* cited by examiner

*Primary Examiner* — Steven Douglas
(74) *Attorney, Agent, or Firm* — Matthias Scholl P.C.; Matthias Scholl

(57) ABSTRACT

A mouth and nose mask including a main cover body with a main air vent at the center thereof, an inner cover body, and a linking member. There is a space between the main cover body and the inner cover body. The linking member links the main cover body and the inner cover body. The bottom edge of the inner cover body is designed not to touch the face when wearing. The mouth and nose mask is safe, can be used in the treatment of allergic respiratory diseases, and is effective in preventing the same.

15 Claims, 2 Drawing Sheets

MOUTH AND NOSE MASK FOR PREVENTING AND TREATING ALLERGIC RESPIRATORY DISEASES

CROSS-REFERENCE TO RELATED APPLICATIONS

This application is a continuation of International Patent Application No. PCT/CN2010/070353 with an international filing date of Jan. 26, 2010, designating the United States, now pending, and further claims priority benefits to Chinese Patent Application No. 200910051585.9 filed May 20, 2009, to Chinese Patent Application No. 200910047562.0 filed Mar. 13, 2009, and to Chinese Patent Application No. 200920068835.5 filed Mar. 13, 2009. The contents of all of the aforementioned applications, including any intervening amendments thereto, are incorporated herein by reference.

BACKGROUND OF THE INVENTION

1. Field of the Invention

The invention relates to a mouth and nose mask for preventing and treating allergic respiratory diseases, and more particularly to a mouth and nose mask for preventing and treating allergic asthma, allergic rhinitis, and common cold.

2. Description of the Related Art

Allergic respiratory diseases, for example, asthma, have seriously affected the health and life quality of human beings for a long time. The pathogenesis of asthma is very complex. Conventional concepts assume that the incentives including stimulation of allergens, viruses or bacteria infection, air pollution, climate change (temperature, moisture, air pressure), drug allergy, exercise, mental and emotional factors, etc. are inducing factors of asthma, and the methods for preventing and treating allergic respiratory diseases are mainly dependent on pharmaceuticals and physical treatment. For example, steroid and theophylline drugs, are used to relax the smooth muscle of patients suffering from asthma. The treatment principle targets at alleviating the obstruction of respiratory tract. However, pharmacotherapy has side effects more or less and often leads to drug resistance. Furthermore, pharmaceuticals often have a slow curative effect, and thus they are not practicable for acute patients.

SUMMARY OF THE INVENTION

In view of the above-described problems, the inventors of the invention, based on a large number of experiments, elucidate the key factors of asthma attack. Specifically, the studies show that the climate change (actually, the decrease of temperature) has direct relationship with the asthma attack (other incentives are minor). Thus, warming the respiratory tract is an effective means for the prevention and treatment of allergic respiratory diseases comprising asthma.

The invention is based on the new concept described below.

For people with an allergic constitution, when the ambient temperature drops suddenly, the incentives comprising stimulation of allergens, viruses or bacteria infection, exercise, and emotional fluctuation stimulate the respiratory tract to produce abnormal reactions. If the abnormal reactions happen in the bronchia, the bronchial mucosal edema obstructs the airway, and thus asthma occurs. If the abnormal reactions happen in the nasal cavity, the nasal mucosal edema obstructs the nasal cavity, and thus allergic rhinitis occurs.

It is well-known that with the drop of the ambient temperature, the human immunity decreases accordingly, and the bacteria or viruses invades easily. For people with a non-allergic constitution, the sudden drop of the ambient temperature may cause common cold, but won't cause allergic diseases because those people do not have airway hyperreactivity.

The sudden drop of the ambient temperature is a necessary condition to induce asthma. The incentives comprising stimulation of allergens, viruses or bacteria infection, exercise, and emotional fluctuation are secondary factors to induce asthma. That is to say, if there is no sudden drop of the ambient temperature, even though the incentives exist, the risk of asthma attack will be very low.

The sudden drop of the ambient temperature refers to a constant decrease of the temperature in a limited time. If the declining slope is always greater than zero in the limited time, the allergic respiratory diseases occurs with a high probability. In a daily temperature curve (profile), the hours with a temperature drop are the theoretical time points of asthma attack. The larger the drop rate of the temperature, the longer the drop time of the temperature, the easier the asthma attack occurs. That is why the asthma attack easily occurs at night or in the morning in the autumn, winter, or spring. That further explains why in the summer, although there are high density of bacteria and mites in the air, almost no asthma attack occurs.

Thus, removing or compensating the sudden drop of the ambient temperature can effectively prevent and treat allergic respiratory diseases comprising asthma. On the other side, people who are already under asthma attack can recover soon after his respiratory tract is being warmed for 1 to 2 hours.

To achieve the above objectives, in accordance with one embodiment of the invention, there is provided a mouth and nose mask comprising a main cover body with a main air vent at the center thereof, an inner cover body, and a linking member, wherein there is a space between the main cover body and the inner cover body; the linking member links the main cover body and the inner cover body; and an extension length of the bottom edge of the inner cover body is shorter than that of the main cover body, for air to be inhaled and exhaled freely.

In a class of this embodiment, the linking member is a link rod.

In a class of this embodiment, the main air vent is round in shape with a diameter of between 2 and 3 cm.

In a class of this embodiment, the main cover body further comprises a medical rubber gasket on the bottom edge thereof.

In a class of this embodiment, an auxiliary air vent is disposed on the main cover body.

In a class of this embodiment, the auxiliary air vent is three in number.

In a class of this embodiment, the auxiliary air vent is 2 mm in diameter.

In a class of this embodiment, a link groove and a fixing band are disposed on the main cover body.

In a class of this embodiment, a heater coil heated by AC or DC is disposed inside the inner cover body.

In a class of this embodiment, a sodium peroxide flaky patch is disposed inside the inner cover body.

In a class of this embodiment, the sodium peroxide flaky patch comprises a gelatin layer and a material layer comprising sodium peroxide, sickle stones, and a non-woven bag.

In a class of this embodiment, the mouth and nose mask further comprises a temperature indicator.

Advantages of the invention are summarized below.

1. The mouth and nose mask keeps warming the respiratory tract of patients continuously, the air temperature is maintained at between 24 and 30° C., independent of time and space, thereby eliminating the influence of the sudden drop of ambient temperature on the respiratory tract of patients. If the user is already under asthma attack, with this mask he can recover soon because his respiratory tract is warmed according to above studies mentioned.

2. Prevention and treatment of allergic respiratory tract diseases using the mouth and nose mask has no side effect and drug resistance caused by pharmacotherapy.

3. The mouth and nose mask is designed according to human facial shape, providing a comfortable wear. It is portable, maintenance-free and easy to use.

4. The main and auxiliary air vents ensure the air volume about 200 mL, benefiting the gas exchange.

5. The sodium peroxide flaky patch can prevent the occurrence of high concentration of $CO_2$ and supplement oxygen, meanwhile assist to improve the air temperature.

BRIEF DESCRIPTION OF THE DRAWINGS

The invention is described hereinbelow with reference to accompanying drawings, in which.

Figure 1:
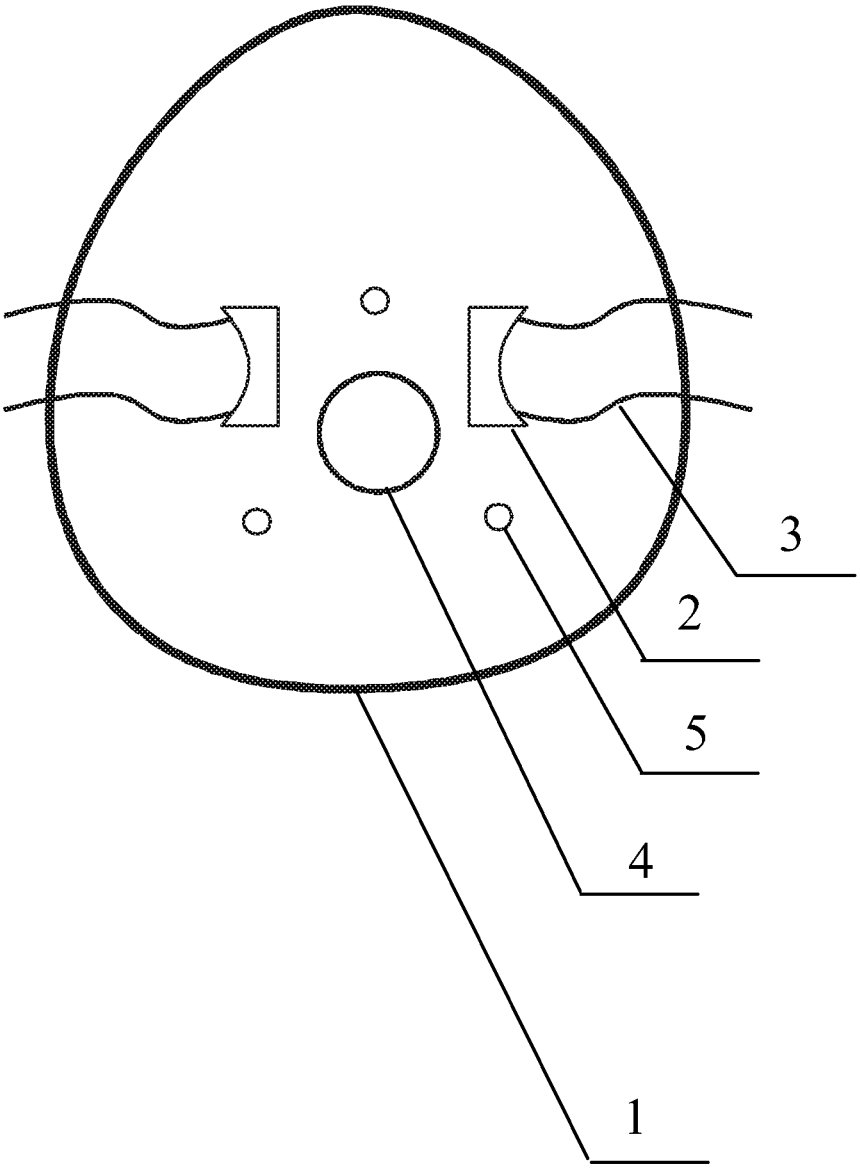
FIG. 1 is a front view of a mouth and nose mask according to one embodiment of the invention.
Figure 2:
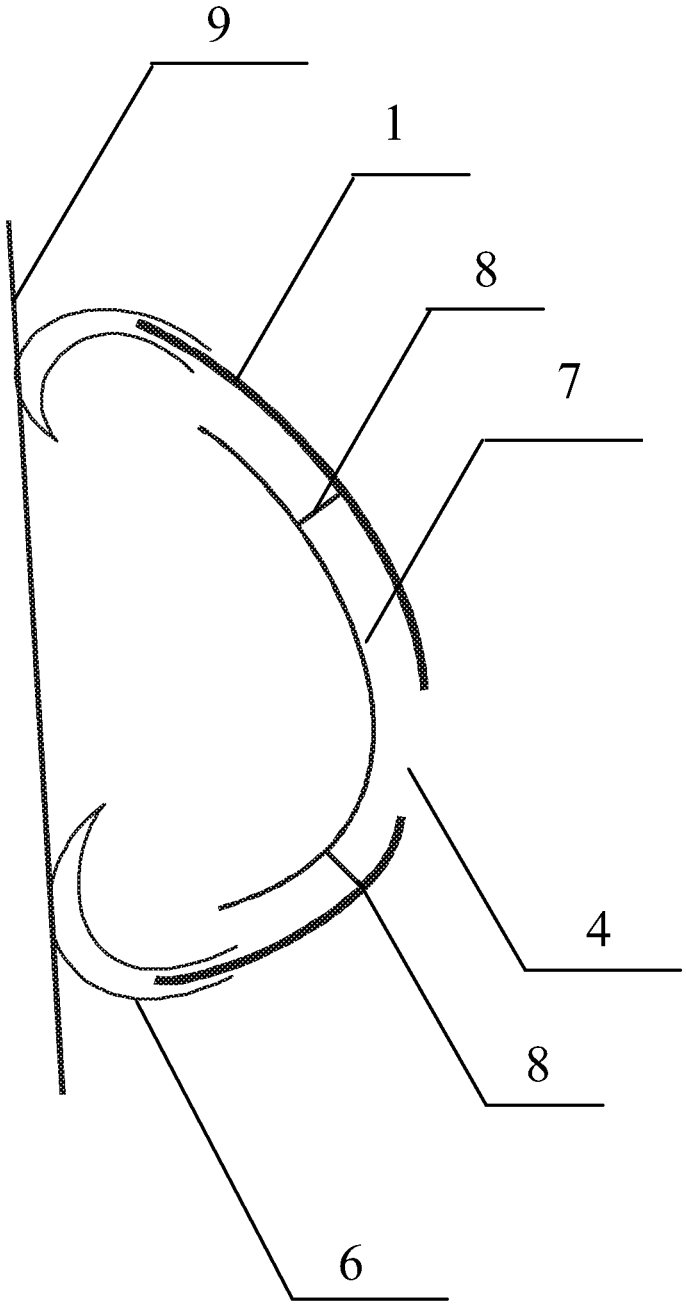
FIG. 2 is a side view of a mouth and nose mask according to one embodiment of the invention.

In the drawings, the following reference numbers are used: 1. Main cover body; 2. Link groove; 3. Fixing band; 4. Main air vent; 5. Auxiliary air vent; 6. Rubber gasket; 7. Inner cover body; 8. Link rod; 9. Skin surface.

DETAILED DESCRIPTION OF THE EMBODIMENTS

For further illustrating the invention, experiments detailing a mouth and nose mask for preventing and treating allergic respiratory diseases are described below. It should be noted that the following examples are intended to describe and not to limit the invention.

A mouth and nose mask comprises a main cover body 1 with a main air vent 4 at the center thereof, an inner cover body 7, and a linking member. There is a space between the main cover body 1 and the inner cover body 7. The linking member links the main cover body 1 and the inner cover body 7. An extension length of the bottom edge of the inner cover body is shorter than that of the main cover body. That is to say, the bottom edge of the inner cover body 7 is designed not to touch the skin surface 9 when wearing.

The shape of the main cover body 1 and the inner cover body 7 is similar. The size of the main air vent 4 is designed according to respiratory volume of patients, generally round in shape with a diameter of between 2 and 3 cm. About three auxiliary air vents 5 (about 2 mm in diameter) are disposed on the main cover body 1. A link groove 2 and a fixing band 3 are disposed on the main cover body 1 to fix the mask on the head. The linking member is a link rod 8. The main cover body 1 further comprises a medical rubber gasket 6 on the bottom edge thereof to make the wearer comfortable.

Air is inhaled into the mouth and nose mask via the main air vent 1 and spreads along the edge of the inner cover body 7 and exhaled along the reverse route. Thus, both the direct stimulation of cold air on the respiratory tract and the heat dissipation of the expired gas are greatly buffered. The temperature of the inhaled gas is maintained at around between 24 and 30° C.

The main cover body 1 and the inner cover body 7 are made of pharmaceutically-acceptable hard plastic, with a certain thickness, which is durable and not easy to deform. The direct contact part of the inner cover body and the expired gas can be made of an efficient thermal energy storage material so that the heat of the expired gas is preserved. To enhance the insulation effect, a heater coil heated by AC or DC is disposed inside the inner cover body 7.

For patients sensitive to high concentration of $CO_2$, the inner cover body 7 of the mouth and nose mask is disposed with a sodium peroxide flaky patch. The sodium peroxide flaky patch comprises a gelatin layer and a material layer. 50 g of sodium peroxide and a few sickle stones are mixed and put into a uniform and watertight non-woven bag with good permeability to form the material layer. The gelatin layer is pasted to the material layer and the other side thereof adheres to the inner cover body. Sodium peroxide reacts with the expired $CO_2$ to yield heat and oxygen. The sickle stones have functions of heat preservation. Thus, the mouth and nose mask can prevent the occurrence of high concentration of $CO_2$ and supplement oxygen, meanwhile assist to improve the air temperature. In the flaky patch, dried sodium hydroxide can take the place of sodium peroxide to absorb expired $CO_2$ and vapor.

The mouth and nose mask further comprises a temperature indicator to show the temperature of air inside the mask.

Prevention and treatment of allergic respiratory tract diseases using the mouth and nose mask has no side effect and drug resistance caused by pharmacotherapy. The mouth and nose mask is safe, effective, and well targeted, which greatly reduces the mortality of asthma patients.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A mouth and nose mask comprising:

a) a main cover body with a main air vent at the center thereof;

b) an inner cover body, the inner cover body comprising a peripheral edge and a bottom edge; and c) a linking member;

wherein:

an intermediate space is formed between the main cover body and the inner cover body;

the linking member links the main cover body and the inner cover body;

the inner cover body covers the main air vent;

the peripheral edge is spaced from the main cover body and an air gap is formed between the peripheral edge and the main cover body; and an extension length of the bottom edge of the inner cover body is shorter than that of the main cover body.

2. The mask of claim 1, wherein the linking member is a link rod.

3. The mask of claim 1, wherein the main air vent is round in shape with a diameter of between 2 and 3 cm.

4. The mask of claim 1, wherein the main cover body further comprises a medical rubber gasket on the bottom edge thereof.

5. The mask of claim 1, wherein an auxiliary air vent is disposed on the main cover body.

6. The mask of claim 5, wherein the auxiliary air vent is three in number.

7. The mask of claim 5, wherein the auxiliary air vent is 2 mm in diameter.

8. The mask of claim 1, wherein a link groove and a fixing band are disposed on the main cover body.

9. The mask of claim 1, wherein the inner cover body is impervious to air.

10. The mask of claim 1, wherein when the mask is worn by a wearer, a flow of air exhaled by the wearer flows through the gap into the intermediate space, and then flows through the main air vent to an outside of the mask; and a flow of air inhaled by the wearer flows through the main air vent into the intermediate space, and then flows through the gap toward the wearer's mouth and/or nose.

11. The mask of claim 1, wherein when the mask is worn by a wearer, the inner cover body blocks a flow of air exhaled by the wearer and stops a stream of the air exhaled by the wearer from exiting the mask; and a flow of air inhaled by the wearer of the mask flows through the main air vent into the mask and mixes with the stream of the air exhaled by the wearer.

12. The mask of claim 1, wherein when the mask is worn by a wearer, a surface of the inner cover body that faces toward the wearer's mouth and nose reflects a flow of air exhaled by the wearer and directs the flow of the exhaled air toward the wearer's mouth and nose.

13. A mouth and nose mask, comprising:

a) a main cover body, the main cover body comprising a main air vent;

b) an inner cover body, the inner cover body comprising a first surface, a second surface, and a peripheral edge; and c) a link rod, the link rod comprising a first end and a second end; wherein:

the first end is connected to the main cover body and the second end is connected to the first surface to fix the inner cover body at a distance from the main cover body;

the inner cover body covers the main air vent;

a gap is formed between the peripheral edge and the main cover body; and an intermediate space is formed between the inner cover body and the main cover body; and when the mask is worn by a wearer, the second surface faces toward the wearer's mouth and nose; and the second surface reflects a flow of air exhaled by the wearer and directs the flow of the exhaled air toward the wearer's mouth and nose.

14. The mask of claim 12, wherein:

the main cover body is impervious to air; and the inner cover body is impervious to air.

15. A mouth and nose mask, comprising:

a) a main cover body, the main cover body comprising a central area and a main air vent;

b) an inner cover body, the inner cover body comprising an outer surface, an inner surface, and a peripheral edge; and c) a link rod, the link rod comprising a first end and a second end;

wherein:

the main air vent is disposed in the central area;

the first end is connected to the main cover body;

the second end is connected to the outer surface;

the inner cover body is spaced from the main cover body;

an intermediate space is formed between the inner cover body and the main cover body;

the inner cover body covers the central area and shields the main air vent;

the peripheral edge is spaced from the main cover body;

a gap is formed between the peripheral edge and the main cover body; and the main cover body and the inner cover body are impervious to air; and when the mask is worn by a wearer, the inner cover body covers the wearer's mouth and nose;

the inner surface faces toward the wearer's mouth and nose; and the inner surface reflects a flow of air exhaled by the wearer and directs the flow of the exhaled air toward the wearer's mouth and nose.

* * * * *